US007498108B2

(12) United States Patent
Wu et al.

(10) Patent No.: US 7,498,108 B2
(45) **Date of Patent: *Mar. 3, 2009**

(54) THIOPHOSPHATE CONTAINING PHOTOCONDUCTORS

(75) Inventors: Jin Wu, Webster, NY (US); Satchidanand Mishra, Webster, NY (US); Kent J. Evans, Lima, NY (US); J. Robinson Cowdery-Corvan, Webster, NY (US); Anthony M. Horgan, Pittsford, NY (US); Geoffrey M T. Foley, Fairport, NY (US); Kathleen M. Carmichael, Williamson, NY (US); Liang-Bih Lin, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 76 days.

This patent is subject to a terminal disclaimer.

(21) Appl. No.: 11/453,743

(22) Filed: Jun. 15, 2006

(65) Prior Publication Data

US 2007/0292793 A1 Dec. 20, 2007

(51) Int. Cl.
*G03G 5/047* (2006.01)

(52) U.S. Cl. ..... 430/59.1; 430/58.8; 430/59.4; 430/60

(58) Field of Classification Search ..... 430/58.8, 430/59.4, 60, 108.1, 109.4
See application file for complete search history.

(56) References Cited

U.S. PATENT DOCUMENTS

| | | | | |
|---|---|---|---|---|
| 3,121,006 | A | 2/1964 | Middleton et al. | |
| 3,871,882 | A | 3/1975 | Wiedemann | |
| 4,265,990 | A | 5/1981 | Stolka et al. | |
| 4,298,697 | A | 11/1981 | Baczek | |
| 4,338,390 | A | 7/1982 | Lu | |
| 4,443,528 | A * | 4/1984 | Tamura et al. | 430/56 |
| 4,464,450 | A | 8/1984 | Teuscher | |
| 4,555,463 | A | 11/1985 | Hor et al. | |
| 4,560,635 | A | 12/1985 | Hoffend et al. | |
| 4,587,189 | A | 5/1986 | Hor et al. | |
| 4,921,769 | A | 5/1990 | Yuh et al. | |
| 4,921,773 | A | 5/1990 | Melnyk et al. | |
| 5,473,064 | A | 12/1995 | Mayo et al. | |
| 5,482,811 | A | 1/1996 | Keoshkerian et al. | |
| 5,521,306 | A | 5/1996 | Burt et al. | |
| 6,156,468 | A | 12/2000 | Wehelie et al. | |
| 6,177,219 | B1 | 1/2001 | Yuh et al. | |
| 6,255,027 | B1 | 7/2001 | Wehelie et al. | |
| 6,573,016 | B2 * | 6/2003 | Kami et al. | 430/58.05 |
| 6,913,863 | B2 | 7/2005 | Wu et al. | |
| 7,037,631 | B2 | 5/2006 | Wu et al. | |
| 2004/0126685 | A1 * | 7/2004 | Horgan et al. | 430/58.3 |
| 2006/0105254 | A1 | 5/2006 | Wu et al. | |
| 2007/0026329 | A1 * | 2/2007 | Wu et al. | 430/58.05 |
| 2007/0026330 | A1 * | 2/2007 | Wu et al. | 430/58.05 |

OTHER PUBLICATIONS

See the "Cross Reference to Related Applications" on pp. 1 and 2 of the specification being filed concurrently.
Jin Wu et al., U.S. Appl. No. 11/126,664 on Photoconductive Members, filed May 11, 2005.
Jin Wu et al., U.S. Appl. No. 11/193,242 on Polytetrafluoroethylene-doped Photoreceptor Layer Having Polyol Ester Lubricants, filed Jul. 28, 2005.
Jin Wu et al., U.S. Appl. No. 11/193,541 on Photoreceptor Layer Having Solid and Liquid Lubricants, filed Jul. 28, 2005.
Jin Wu et al., U.S. Appl. No. 11/193,672 on Photoreceptor Layer Having Polyphenyl Ether Lubricants, filed Jul. 28, 2005.
Jin Wu et al., U.S. Appl. No. 11/193,241 on Photoreceptor Layer Having Dialkyldithiophosphate Lubricant, filed Jul. 28, 2005.
Jin Wu et al., U.S. Appl. No. 11/193,129 on Photoreceptor Layer Having Phosphate-based Lubricant, filed Jul. 28, 2005.
Jin Wu et al., U.S. Appl. No. 11/193,754 on Photoreceptor Layer Having Antioxidant Lubricant Additives, filed Jul. 28, 2005.

* cited by examiner

*Primary Examiner*—Christopher RoDee
*Assistant Examiner*—Peter L Vajda
(74) *Attorney, Agent, or Firm*—Eugene O. Palazzo

(57) ABSTRACT

An imaging member containing an optional supporting substrate, a photogenerating layer and at least one charge transport layer, and wherein said photogenerating layer contains at least one thiophosphate.

28 Claims, No Drawings

THIOPHOSPHATE CONTAINING PHOTOCONDUCTORS

CROSS REFERENCE TO RELATED APPLICATIONS

U.S. application Ser. No. 11/453,618, filed Jun. 15, 2006, on Ether Containing Photoconductors, by Jin Wu et al.

U.S. application Ser. No. 11/453,392, filed Jun. 15, 2006, on Ether Phosphate Containing Photoconductors, by Jin Wu et al.

U.S. application Ser. No. 11/453,621, filed Jun. 15, 2006, on Ether Phosphate Containing Photoconductors, by Jin Wu et al.

U.S. application Ser. No. 11/453,622, filed Jun. 15, 2006, on Polyphenyl Ether Containing Photoconductors, by Jin Wu et al.

U.S. application Ser. No. 11/453,379, filed Jun. 15, 2006, on Polyphenyl Ether Phosphate Containing Photoconductors, by Jin Wu et al.

U.S. application Ser. No. 11/453,742, filed Jun. 15, 2006, on Polyphenyl Ether Phosphate Containing Photoconductors, by Jin Wu et al.

U.S. application Ser. No. 11/453,740 , filed Jun. 15, 2006, on Polyphenyl Thioether Containing Photoconductors, by Jin Wu et al.

U.S. application Ser. No. 11/453,607, filed Jun. 15. 2006, on Polyphenyl Thioether Phosphate Containing Photoconductors, by Jin Wu et al.

U.S. application Ser. No. 11/453,739, filed Jun. 15, 2006, on Polyphenyl Thioether Phosphate Containing Photoconductors, by Jin Wu et al.

U.S. application Ser. No. 11/453,613, filed Jun. 15, 2006, on Thiophosphate Containing Photoconductors, by Jin Wu et al.

U.S. application Ser. No. 11/453,489, filed Jun. 15, 2006, on Thiophosphate Containing Photoconductors, by Jin Wu et al.

The following patents and copending commonly assigned patent applications are recited:

U.S. patent application Ser. No. 11/126,664, filed May 11, 2005, entitled Photoconductive Members; U.S. patent application Ser. No. 11/193,242, filed Jul. 28, 2005, entitled Polytetrafluoroethylene-doped Photoreceptor Layer Having Polyol Ester Lubricants; U.S. patent application Ser. No. 11/193,541, filed Jul. 28, 2005, entitled Photoreceptor Layer Having Solid and Liquid Lubricants; U.S. patent application Ser. No. 11/193,672, filed Jul. 28, 2005, entitled Photoreceptor Layer having Polyphenyl Ether Lubricant; U.S. patent application Ser. No. 11/193,241, filed Jul. 28, 2005, entitled Photoreceptor Layer Having Dialkyldithiophosphate Lubricant; U.S. patent application Ser. No. 11/193,129, filed Jul. 28, 2005, entitled Photoreceptor Layer having Phosphate-based Lubricant; and U.S. patent application Ser. No. 11/193,754, filed Jul. 28, 2005, entitled "Photoreceptor Layer having Antioxidant Lubricant Additives." The disclosures of each of these applications are totally incorporated herein by reference in their entireties.

There is illustrated in U.S. Pat. No. 7,037,631, the disclosure of which is totally incorporated herein by reference, a photoconductive imaging member comprised of a supporting substrate, a hole blocking layer thereover, a crosslinked photogenerating layer and a charge transport layer, and wherein the photogenerating layer is comprised of a photogenerating component and a vinyl chloride, allyl glycidyl ether, hydroxy containing polymer.

There is illustrated in U.S. Pat. No. 6,913,863, the disclosure of which is totally incorporated herein by reference, a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

A number of the components and amounts thereof of the above copending applications and patents, such as the supporting substrates, resin binders, photogenerating layer components, antioxidants, charge transport components, ethers, thiophosphates, hole blocking layer components, adhesive layers, and the like may be selected for the members of the present disclosure in embodiments thereof.

BACKGROUND

This disclosure is generally directed to layered imaging members, photoreceptors, photoconductors, and the like. More specifically, the present disclosure is directed to multilayered flexible, belt imaging members, or devices comprised of an optional supporting medium like a substrate, a photogenerating layer, and a charge transport layer, especially a plurality of charge transport layers, such as a first charge transport layer and a second charge transport layer, an optional adhesive layer, an optional hole blocking or undercoat layer, and an optional overcoating layer, and wherein at least one of the charge transport layers contains at least one charge transport component, a polymer or resin binder, a suitable ether like a C-ether, a polyphenyl ether, or a polyphenyl thioether, and an optional antioxidant. Moreover, the photogenerating layer and at least one of the charge transport layers may in embodiments contain a thiophosphate. The photoreceptors illustrated herein, in embodiments, have excellent wear resistance, extended lifetimes, elimination or minimization of imaging member scratches on the surface layer or layers of the member, and which scratches can result in undesirable print failures where, for example, the scratches are visible on the final prints generated. Additionally, in embodiments the imaging members disclosed herein possess excellent, and in a number of instances low $V_r$ (residual potential), and allow the substantial prevention of $V_r$ cycle up when appropriate; high sensitivity; low acceptable image ghosting characteristics; and desirable toner cleanability. More specifically, there is illustrated herein in embodiments the incorporation of suitable ethers in the imaging member to permit scratch resistant characteristics, and the optional incorporation into the imaging member of suitable thiophosphates to enable excellent member electrical properties.

Also included within the scope of the present disclosure are methods of imaging and printing with the photoresponsive devices illustrated herein. These methods generally involve the formation of an electrostatic latent image on the imaging member, followed by developing the image with a toner composition comprised, for example, of thermoplastic resin, colorant, such as pigment, charge additive, and surface additive, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same operation with the exception that exposure can be accomplished with a laser device or image bar. More specifically, the scratch resistant imaging members and flexible belts disclosed herein can be selected for the Xerox Corporation iGEN machines that generate with some versions over 100 copies per minute. Processes of imaging, especially xerographic imaging and printing, including digital, and/or color printing, are thus encompassed by the present disclosure.

The layered photoconductive imaging members of the present disclosure can be selected for a number of different known imaging and printing processes including, for example, electrophotographic imaging processes, especially xerographic imaging and printing processes wherein charged latent images are rendered visible with toner compositions of an appropriate charge polarity. The imaging members are in embodiments sensitive in the wavelength region of, for example, from about 400 to about 900 nanometers, and in particular from about 650 to about 850 nanometers, thus diode lasers can be selected as the light source. Moreover, the imaging members of this disclosure are useful in color xerographic applications, particularly high-speed color copying and printing processes.

REFERENCES

Layered photoresponsive imaging members have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound and an amine hole transport dispersed in an electrically insulating organic resin binder.

There are disclosed in U.S. Pat. No. 3,871,882, the disclosure of which is totally incorporated herein by reference, photoconductive substances comprised of specific perylene-3,4,9,10-tetracarboxylic acid derivative dyestuffs. In accordance with this patent, the photoconductive layer is preferably formed by vapor depositing the dyestuff in a vacuum. Also, there are disclosed in this patent dual layer photoreceptors with perylene-3,4,9,10-tetracarboxylic acid diimide derivatives, which have spectral response in the wavelength region of from 400 to 600 nanometers. Further, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a perylene, pigment photogenerating component. Both of the aforementioned patents disclose an aryl amine component, such as N,N'-diphenyl-N,N'-bis(3-methylphenyl)-1,1'-biphenyl-4,4'-diamine dispersed in a polycarbonate binder as a hole transport layer. The above components, such as the photogenerating compounds and the aryl amine charge transport, can be selected for the imaging members of the present disclosure in embodiments thereof.

In U.S. Pat. No. 4,921,769, the disclosure of which is totally incorporated herein by reference, there are illustrated photoconductive imaging members with blocking layers of certain polyurethanes.

Illustrated in U.S. Pat. Nos. 6,255,027; 6,177,219, and 6,156,468, the disclosures of which are totally incorporated herein by reference, are, for example, photoreceptors containing a hole blocking layer of a plurality of light scattering particles dispersed in a binder, reference for example, Example I of U.S. Pat. No. 6,156,468, the disclosure of which is totally incorporated herein by reference, wherein there is illustrated a hole blocking layer of titanium dioxide dispersed in a specific linear phenolic binder of VARCUM™, available from OxyChem Company.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments which comprises hydrolyzing a gallium phthalocyanine precursor pigment by dissolving the hydroxygallium phthalocyanine in a strong acid and then reprecipitating the resulting dissolved pigment in basic aqueous media; removing any ionic species formed by washing with water, concentrating the resulting aqueous slurry comprised of water and hydroxygallium phthalocyanine to a wet cake; removing water from said slurry by azeotropic distillation with an organic solvent, and subjecting said resulting pigment slurry to mixing with the addition of a second solvent to cause the formation of said hydroxygallium phthalocyanine polymorphs.

Also, in U.S. Pat. No. 5,473,064, the disclosure of which is totally incorporated herein by reference, there is illustrated a process for the preparation of photogenerating pigments of hydroxygallium phthalocyanine Type V essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($Dl^3$) in an amount of from about 1 part to about 10 parts, and preferably about 4 parts of $Dl^3$, for each part of gallium chloride that is reacted; hydrolyzing said pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts and preferably about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

The appropriate components, and processes of the above-recited patents may be selected for the present invention in embodiments thereof.

SUMMARY

Disclosed are imaging members with many of the advantages illustrated herein, such as extended lifetimes of service of, for example, in excess of about 3,500,000 imaging cycles;

excellent electronic characteristics; stable electrical properties; low image ghosting; resistance to charge transport layer cracking upon exposure to the vapor of certain solvents; excellent surface characteristics; improved wear resistance; compatibility with a number of toner compositions; the avoidance of or minimal imaging member scratching characteristics; consistent $V_r$ (residual potential) that is substantially flat or no change over a number of imaging cycles as illustrated by the generation of known PIDC (Photo-induced Discharge Curve), and the like.

Also disclosed are layered anti-scratch photoresponsive imaging members which are responsive to near infrared radiation of from about 700 to about 900 nanometers.

Further disclosed are layered flexible photoresponsive imaging members with sensitivity to visible light.

Moreover, disclosed are layered belt photoresponsive or photoconductive imaging members with mechanically robust and solvent resistant charge transport layers.

Additionally disclosed are flexible imaging members with optional hole blocking layers comprised of metal oxides, phenolic resins, and optional phenolic compounds, and which phenolic compounds contain at least two, and more specifically, two to ten phenol groups or phenolic resins with, for example, a weight average molecular weight ranging from about 500 to about 3,000, permitting, for example, a hole blocking layer with excellent efficient electron transport which usually results in a desirable photoconductor low residual potential $V_{low}$.

Also disclosed are layered flexible belt photoreceptors containing a wear resistant, and anti-scratch layer or layers, and where the surface hardness of the member is increased by the addition of suitable ethers and thiophosphates; and the prevention of $V_r$ cycle up caused primarily by photoconductor aging for numerous imaging cycles.

EMBODIMENTS

In an electrostatographic reproducing apparatus for which the photoconductors of the present disclosure can be selected, a light image of an original to be copied is recorded in the form of an electrostatic latent image upon a photosensitive member, and the latent image is subsequently rendered visible by the application of electroscopic thermoplastic resin particles, which are commonly referred to as toner. Specifically, the photoreceptor is charged on its surface by means of an electrical charger to which a voltage has been supplied from a power supply. The photoreceptor is then imagewise exposed to light from an optical system or an image input apparatus, such as a laser and light emitting diode, to form an electrostatic latent image thereon. Generally, the electrostatic latent image is developed by a developer mixture of toner and carrier particles. Development can be accomplished by known processes, such as a magnetic brush, powder cloud, highly agitated zone development, or other known development process.

After the toner particles have been deposited on the photoconductive surface. in image configuration, they are transferred to a copy sheet by a transfer means, which can be pressure transfer or electrostatic transfer. In embodiments, the developed image can be transferred to an intermediate transfer member, and subsequently transferred to a copy sheet.

When the transfer of the developed image is completed, a copy sheet advances to the fusing station with fusing and pressure rolls, wherein the developed image is fused to a copy sheet by passing the copy sheet between the fusing member and pressure member, thereby forming a permanent image. Fusing may be accomplished by other fusing members, such as a fusing belt in pressure contact with a pressure roller, fusing roller in contact with a pressure belt, or other like systems.

Aspects of the present disclosure relate to an imaging member comprising an optional supporting substrate, a photogenerating layer, and at least one charge transport layer, and wherein the photogenerating layer contains at least one thiophosphate; a flexible photoconductive member comprising in sequence a substrate, a photogenerating layer, and at least one charge transport layer comprised of at least one charge transport component, and wherein the photogenerating layer is comprised of a photogenerating pigment or pigments, and at least one dialkyldithiophosphate of the formulas

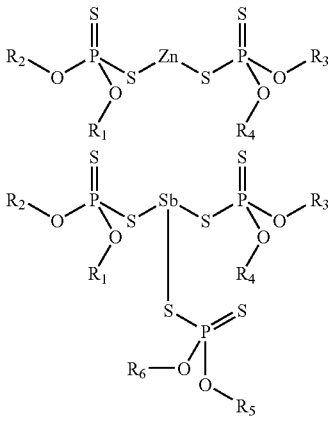

wherein $R_1$, $R_2$, $R_3$, $R_4$, $R_5$ and $R_6$ each independently represents a hydrogen atom, a suitable hydrocarbon like alkyl, cycloalkyl, aryl, alkylaryl or arylalkyl; and a photoconductor comprising a substrate, a photogenerating layer, and a plurality of charge transport layers comprised of at least one, for example 1 to about 8, charge transport component, and wherein the photogenerating layer is comprised of a photogenerating pigment or pigments, and at least one dialkyldithiophosphate of the formulas

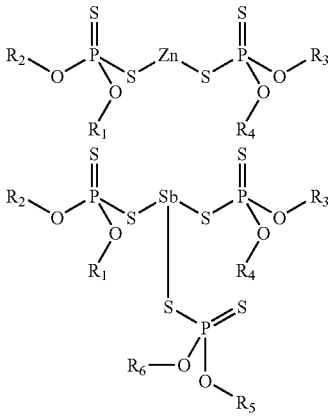

wherein $R_1$, $R_2$, $R_3$, $R_4$, $R_5$ and $R_6$ each independently represents a hydrogen atom or a suitable hydrocarbon; and wherein the photogenerating layer and at least one charge transport layer include a resin binder; wherein the at least one charge transport layer is from 2 to about 7, and the photogenerating layer is situated between the substrate and the at least one charge transport layer.

The thickness of the substrate layer depends on many factors, including economical considerations, electrical characteristics, and the like, thus this layer may be of substantial thickness, for example over 3,000 microns, such as from about 300 to about 700 microns, or of a minimum thickness. In embodiments, the thickness of this layer is from about 75 microns to about 300 microns, or from about 100 to about 150 microns.

The substrate may be opaque or substantially transparent and may comprise any suitable material having the required mechanical properties. Accordingly, the substrate may comprise a layer of an electrically nonconductive or conductive material such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet and the like. The thickness of the substrate layer depends on numerous factors, including strength desired and economical considerations. For a drum, as disclosed in a copending application referenced herein, this layer may be of substantial thickness of, for example, up to many centimeters or of a minimum thickness of less than a millimeter. Similarly, a flexible belt may be of substantial thickness of, for example, about 250 micrometers, or of minimum thickness of less than about 50 micrometers, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically layers selected for the imaging members of the present disclosure, and which substrates can be opaque or substantially transparent comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The photogenerating layer in embodiments is comprised of, for example, about 60 weight percent of Type V hydroxygallium phthalocyanine or chlorogallium phthalocyanine, and about 40 weight percent of a resin binder like poly(vinyl chloride-co-vinyl acetate) copolymer, such as VMCH (available from Dow Chemical). Generally, the photogenerating layer can contain known photogenerating pigments, such as metal phthalocyanines, metal free phthalocyanines, alkylhydroxyl gallium phthalocyanines, hydroxygallium phthalocyanines, chlorogallium phthalocyanines, perylenes, especially bis(benzimidazo)perylene, titanyl phthalocyanines, and the like, and more specifically, vanadyl phthalocyanines, Type V hydroxygallium phthalocyanines, and inorganic components such as selenium, selenium alloys, and trigonal selenium. The photogenerating pigment can be dispersed in a resin binder similar to the resin binders selected for the charge transport layer, or alternatively no resin binder need be present. Generally, the thickness of the photogenerating layer depends on a number of factors, including the thicknesses of the other layers and the amount of photogenerating material contained in the photogenerating layer. Accordingly, this layer can be of a thickness of, for example, from about 0.05 micron to about 10 microns, and more specifically, from about 0.25 micron to about 2 microns when, for example, the photogenerating compositions are present in an amount of from about 30 to about 75 percent by volume. The maximum thickness of this layer in embodiments is dependent primarily upon factors, such as photosensitivity, electrical properties and mechanical considerations. The photogenerating layer binder resin is present in various suitable amounts, for example from about 1 to about 50, and more specifically, from about 1 to about 10 weight percent, and which resin may be selected from a number of known polymers, such as poly (vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of coating solvents for the photogenerating layer are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

Photogenerating layers may comprise amorphous films of selenium and alloys of selenium and arsenic, tellurium, germanium and the like, hydrogenated amorphous silicon and compounds of silicon and germanium, carbon, oxygen, nitrogen and the like fabricated by vacuum evaporation or deposition. The photogenerating layers may also comprise inorganic pigments of crystalline selenium and its alloys; Group II to VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos; and the like dispersed in a film forming polymeric binder and fabricated by solvent coating techniques.

Phthalocyanines have been employed as photogenerating materials for use in laser printers using infrared exposure systems. Infrared sensitivity is usually desired for photoreceptors exposed to low-cost semiconductor laser diode light exposure devices. The absorption spectrum and photosensitivity of the phthalocyanines depend on the central metal atom of the compound. Many metal phthalocyanines have been reported and include oxyvanadium phthalocyanine, chloroaluminum phthalocyanine, copper phthalocyanine, oxytitanium phthalocyanine, chlorogallium phthalocyanine, hydroxygallium phthalocyanine magnesium phthalocyanine and metal free phthalocyanine. The phthalocyanines exist in many crystal forms, and have a strong influence on photogeneration.

In embodiments, examples of polymeric binder materials that can be selected as the matrix for the photogenerating layer are illustrated in U.S. Pat. No. 3,121,006, the disclosure of which is totally incorporated herein by reference. Examples of binders are thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly (phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly(vinyl chloride), vinyl chloride and vinyl acetate copolymers, acrylate copolymers, alkyd resins, cellulosic film formers, poly(amideimide), styrenebutadiene copolymers, vinylidene chloride-vinyl chloride copolymers, vinyl acetate-vinylidene chloride copolymers, styrene-alkyd resins, poly(vinyl carbazole), and the like. These polymers may be block, random or alternating copolymers.

The photogenerating composition or pigment is present in the resinous binder composition in various amounts. Generally, however, from about 5 percent by volume to about 90 percent by volume of the photogenerating pigment is dispersed in about 10 percent by volume to about 95 percent by volume of the resinous binder, or from about 20 percent by volume to about 30 percent by volume of the photogenerating pigment is dispersed in about 70 percent by volume to about 80 percent by volume of the resinous binder composition. In one embodiment, about 8 percent by volume of the photogenerating pigment is dispersed in about 92 percent by volume of the resinous binder composition.

Various suitable and conventional known processes may be used to mix, and thereafter apply the photogenerating layer coating mixture, like spraying, dip coating, roll coating, wire wound rod coating, vacuum sublimation, and the like. For some applications, the photogenerating layer may be fabricated in a dot or line pattern. Removal of the solvent of a solvent-coated layer may be effected by any known conventional techniques such as oven drying, infrared radiation drying, air drying and the like.

The coating of the photogenerating layer in embodiments of the present disclosure can be accomplished with spray, dip or wire-bar methods such that the final dry thickness of the photogenerating layer is as illustrated herein, and can be, for example, from about 0.01 to about 30 microns after being dried at, for example, about 40° C. to about 150° C. for about 15 to about 90 minutes. More specifically, photogenerating layer of a thickness, for example, of from about 0.1 to about 30, or from about 0.5 to about 2 microns can be applied to or deposited on the substrate, on other surfaces in between the substrate and the charge transport layer, and the like. A charge blocking layer or hole blocking layer may optionally be applied to the electrically conductive surface prior to the application of a photogenerating layer. When desired, an adhesive layer may be included between the charge blocking or hole blocking layer or interfacial layer and the photogenerating layer. Usually, the photogenerating layer is applied onto the blocking layer and a charge transport layer or plurality of charge transport layers are formed on the photogenerating layer. This structure may have the photogenerating layer on top of or below the charge transport layer.

In embodiments, a suitable known adhesive layer can be included in the photoconductor. Typical adhesive layer materials include, for example, polyesters, polyurethanes, and the like. The adhesive layer thickness can vary and in embodiments is, for example, from about 0.05 micrometer (500 Angstroms) to about 0.3 micrometer (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying and the like.

As optional adhesive layers usually in contact with or situated between the hole blocking layer and the photogenerating layer, there can be selected various known substances inclusive of copolyesters, polyamides, poly(vinyl butyral), poly (vinyl alcohol), polyurethane and polyacrylonitrile. This layer is, for example, of a thickness of from about 0.001 micron to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure further desirable electrical and optical properties.

The optional hole blocking or undercoat layers for the imaging members of the present disclosure can contain a number of components including known hole blocking components, such as amino silanes, doped metal oxides, TiSi, a metal oxide like titanium, chromium, zinc, tin and the like; a mixture of phenolic compounds and a phenolic resin or a mixture of two phenolic resins, and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene) bisphenol), P (4,4'-(1,4-phenylene diisopropylidene) bisphenol), S (4,4'-sulfonyldiphenol), and Z (4,4'-cyclohexylidenebisphenol); hexafluorobisphenol A (4,4'-(hexafluoro isopropylidene) diphenol), resorcinol, hydroxyquinone, catechin, and the like.

The hole blocking layer can be, for example, comprised of from about 20 weight percent to about 80 weight percent, and more specifically, from about 55 weight percent to about 65 weight percent of a suitable component like a metal oxide, such as $TiO_2$, from about 20 weight percent to about 70 weight percent, and more specifically, from about 25 weight percent to about 50 weight percent of a phenolic resin; from about 2 weight percent to about 20 weight percent and, more specifically, from about 5 weight percent to about 15 weight percent of a phenolic compound preferably containing at least two phenolic groups, such as bisphenol S, and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9. To the above dispersion are added a phenolic compound and dopant followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM™ 29159 and 29101 (available from OxyChem Company), and DURITE™ 97 (available from Borden Chemical); formaldehyde polymers with ammonia, cresol and phenol, such as VARCUM™ 29112 (available from OxyChem Company); formaldehyde polymers with 4,4'-(1-methylethylidene)bisphenol, such as VARCUM™ 29108 and 29116 (available from OxyChem Company); formaldehyde polymers with cresol and phenol, such as VARCUM™ 29457 (available from OxyChem Company), DURITE™ SD-423A, SD-422A (available from Borden Chemical); or formaldehyde polymers with phenol and p-tert-butylphenol, such as DURITE™ ESD 556C (available from Border Chemical).

The optional hole blocking layer may be applied to the substrate. Any suitable and conventional blocking layer capable of forming an electronic barrier to holes between the adjacent photoconductive layer (or electrophotographic imaging layer) and the underlying conductive surface of substrate may be selected.

Aryl amines selected for the charge, especially hole transporting layers, which generally are of a thickness of from about 5 microns to about 75 microns, and more specifically, of a thickness of from about 10 microns to about 40 microns, include molecules of the following formula

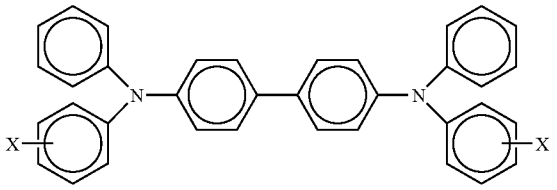

wherein X is alkyl, alkoxy, aryl, a halogen, or mixtures thereof, and especially those substituents selected from the group consisting of Cl and $CH_3$; and molecules of the following formula

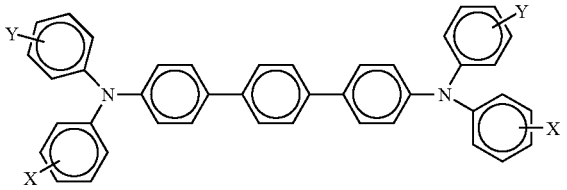

wherein X and Y are independently alkyl, alkoxy, aryl, a halogen, or mixtures thereof.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide and fluoride. Substituted alkyls, alkoxys, and aryls can also be selected in embodiments.

Examples of specific aryl amines include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis (halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules can be selected, reference for example, U.S. Pat. Nos. 4,921,773 and 4,464,450, the disclosures of which are totally incorporated herein by reference.

Examples of the binder materials selected for the charge transport layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly (4,4'-isopropylidene-diphenylene)carbonate (also referred to as bisphenol-A-polycarbonate), poly(4,4'-cyclohexylidine-diphenylene)carbonate (also referred to as bisphenol-Z-polycarbonate), poly(4,4'-isopropylidene-3,3'-dimethyl-diphenyl) carbonate (also referred to as bisphenol-C-polycarbonate), and the like. In embodiments, electrically inactive binders are comprised of polycarbonate resins with a molecular weight of from about 20,000 to about 100,000, or with a molecular weight Mw of from about 50,000 to about 100,000 preferred. Generally, the transport layer contains from about 10 to about 75 percent by weight of the charge transport material, and more specifically, from about 35 percent to about 50 percent of this material.

The charge transport layer or layers, and more specifically, a first charge transport in contact with the photogenerating layer, and thereover a top or second charge transport overcoating layer may comprise charge transporting small molecules dissolved or molecularly dispersed in a film forming electrically inert polymer such as a polycarbonate. In embodiments, "dissolved" refers, for example, to forming a solution in which the small molecule is dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, charge transport refers, for example, to charge transporting molecules as a monomer that allows the free charge generated in the photogenerating layer to be transported across the transport layer.

Examples of charge transporting molecules, especially for the first and second charge transport layers, include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1 '-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine; hydrazones such as N-phenyl-N-methyl-3-(9-ethyl)carbazyl hydrazone and 4-diethyl amino benzaldehyde-1,2-diphenyl hydrazone; and oxadiazoles such as 2,5-bis(4-N,N'-diethylaminophenyl)-1,2,4-oxadiazole, stilbenes, and the like. However, in embodiments to minimize or avoid cycle-up in equipment, such as printers, with high throughput, the charge transport layer should be substantially free (less than about two percent) of di or triamino-triphenyl methane. A small molecule charge transporting compound that permits injection of holes into the photogenerating layer with high efficiency and transports them across the charge transport layer with short transit times includes N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine, or mixtures thereof. If desired, the charge transport material in the charge transport layer may comprise a polymeric charge transport material or a combination of a small molecule charge transport material and a polymeric charge transport material.

A number of processes may be used to mix and thereafter apply the charge transport layer or layers coating mixture to the photogenerating layer. Typical application techniques include spraying, dip coating, roll coating, wire wound rod coating, and the like. Drying of the charge transport deposited coating may be effected by any suitable conventional technique such as oven drying, infrared radiation drying, air drying, and the like.

The thickness of each of the charge transport layers in embodiments is from about 10 to about 70 micrometers, but thicknesses outside this range may in embodiments also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to 200:1, and in some instances 400:1. The charge transport layer is substantially nonabsorbing to visible light or radiation in the region of intended use, but is electrically "active" in that it allows the injection of photogenerated holes from the photoconductive layer, or photogenerating layer, and allows these holes to be transported through itself to selectively discharge a surface charge on the surface of the active layer.

The thickness of the continuous charge transport overcoat layer selected depends upon the abrasiveness of the charging (bias charging roll), cleaning (blade or web), development (brush), transfer (bias transfer roll), and the like in the system employed, and can be up to about 10 micrometers. In embodiments, this thickness for each layer is from about 1 micrometer to about 5 micrometers. Various suitable and conventional methods may be used to mix, and thereafter apply the overcoat layer coating mixture to the photogenerating layer. Typical application techniques include spraying, dip coating, roll coating, wire wound rod coating, and the like. Drying of the deposited coating may be effected by any suitable conventional technique, such as oven drying, infrared radiation drying, air drying, and the like. The dried overcoating layer of this disclosure should transport holes during imaging and should not have too high a free carrier concentration. Free carrier concentration in the overcoat increases the dark decay.

The overcoat layer or layers can comprise the same components as the charge transport layer wherein the weight ratio between the charge transporting small molecule and the suitable electrically inactive resin binder is less, such as for example, from about 0/100 to about 60/40, or from about 20/80 to about 40/60.

Aspects of the present disclosure relate to a photoconductive imaging member comprised of a supporting substrate, a photogenerating layer, a charge transport layer, and an overcoating charge transport layer; a photoconductive member with a photogenerating layer of a thickness of from about 0.1 to about 10 microns, at least one transport layer each of a thickness of from about 5 to about 100 microns; an imaging method and an imaging apparatus containing a charging component, a development component, a transfer component, and a fixing component, and wherein the apparatus contains a photoconductive imaging member comprised of a supporting substrate, and thereover a layer comprised of a photogenerating pigment and a charge transport layer or layers, and thereover an overcoating charge transport layer, and where the transport layer is of a thickness of from about 40 to about 75 microns; a member wherein the ether component, such as a C-ether, a polyphenyl ether, a polyphenyl thioether, or mixtures thereof, is present in an amount of from about 0.1 to about 30 weight percent, or from about 1 to about 10 weight percent; a member wherein the photogenerating layer contains a photogenerating pigment present in an amount of from about 5 to about 95 weight percent; a member wherein the thickness of the photogenerating layer is from about 0.1 to about 4 microns; a member wherein the photogenerating layer contains a polymer binder; a member wherein the binder is present in an amount of from about 50 to about 90 percent by weight, and wherein the total of all layer components is about 100 percent; a member wherein the photogenerating component is a hydroxygallium phthalocyanine that absorbs light of a wavelength of from about 370 to about 950 nanometers; an imaging member wherein the supporting substrate is comprised of a conductive substrate comprised of a metal; an imaging member wherein the conductive substrate is aluminum, aluminized polyethylene terephthalate or titanized polyethylene terephthalate; an imaging member wherein the photogenerating resinous binder is selected from the group consisting of polyesters, polyvinyl butyrals, polycarbonates, polystyrene-b-polyvinyl pyridine, and polyvinyl formals; an imaging member wherein the photogenerating pigment is a metal free phthalocyanine; an imaging member wherein each of the charge transport layers comprises

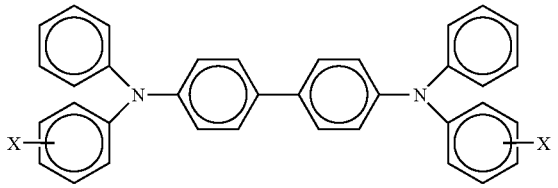

wherein X is selected from the group consisting of alkyl, alkoxy, and halogen; an imaging member wherein alkyl and alkoxy contains from about 1 to about 12 carbon atoms; an imaging member wherein alkyl contains from about 1 to about 5 carbon atoms; an imaging member wherein alkyl is methyl; an imaging member wherein each of or at least one of the charge transport layers comprises

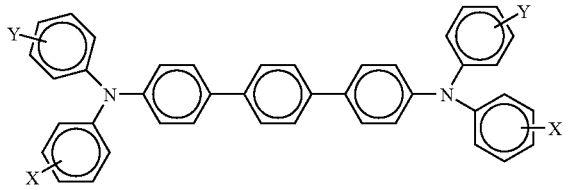

wherein X and Y are independently alkyl, alkoxy, aryl, a halogen, or mixtures thereof; an imaging member wherein alkyl and alkoxy contains from about 1 to about 12 carbon atoms; an imaging member wherein alkyl contains from about 1 to about 5 carbon atoms; and wherein the resinous binder is selected from the group consisting of polycarbonates and polystyrene; an imaging member wherein the photogenerating pigment present in the photogenerating layer is comprised of chlorogallium phthalocyanine, or Type V hydroxygallium phthalocyanine prepared by hydrolyzing a gallium phthalocyanine precursor by dissolving the hydroxygallium phthalocyanine in a strong acid and then reprecipitating the resulting dissolved precursor in a basic aqueous media; removing any ionic species formed by washing with water; concentrating the resulting aqueous slurry comprised of water and hydroxygallium phthalocyanine to a wet cake; removing water from the wet cake by drying; and subjecting the resulting dry pigment to mixing with the addition of a second solvent to cause the formation of the hydroxygallium phthalocyanine; an imaging member wherein the Type V hydroxygallium phthalocyanine has major peaks, as measured with an X-ray diffractometer, at Bragg angles (2 theta+/−0.2°) 7.4, 9.8, 12.4, 16.2, 17.6, 18.4, 21.9, 23.9, 25.0, 28.1 degrees, and the highest peak at 7.4 degrees; a method of imaging which comprises generating an electrostatic latent image on an imaging member developing the latent image, and transferring the developed electrostatic image to a suitable substrate; a method of imaging wherein the imaging member is exposed to light of a wavelength of from about 370 to about 950 nanometers; an imaging apparatus containing a charging component, a development component, a transfer component, and a fixing component; and wherein the apparatus contains a photoconductive imaging member comprised of a supporting substrate, and thereover a layer comprised of photogenerating pigments, and a plurality of charge transport layers; a member wherein the photogenerating layer is situated between the substrate and the charge transport; a member wherein the charge transport layer is situated between the substrate and the photogenerating layer; a member wherein the photogenerating layer is of a thickness of from about 0.1 to about 50 microns; a member wherein the photogenerating component amount is from about 0.05 weight percent to about 20 weight percent, and wherein the photogenerating pigment is optionally dispersed in from about 10 weight percent to about 80 weight percent of a polymer binder; a member wherein the thickness of the photogenerating layer is from about 1 to about 12 microns; a member wherein the photogenerating and charge transport layer components are contained in a polymer binder; a member wherein the binder is present in an amount of from about 50 to about 90 percent by weight, and wherein the total of the layer components is about 100 percent; an imaging member wherein the supporting substrate is comprised of a conductive substrate comprised of a metal; an imaging member wherein the conductive substrate is aluminum or aluminized polyethylene terephthalate; an imaging member wherein the photogenerating resinous binder is selected from the group consisting of polyesters, polyvinyl butyrals, polycarbonates, polystyrene-b-polyvinyl pyridine, and polyvinyl formals; an imaging member wherein the photogenerating component is Type V hydroxygallium phthalocyanine, or chlorogallium phthalocyanine, and the charge transport layer contains a hole transport of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diam ine, N,N'-diphenyl-N,N'-bis(3-chlorophenyl)-[p-terphenyl]-4,4"-diamine molecules, and wherein the hole transport resinous binder is selected from the group consisting of polycarbonates and polystyrene; an imaging member wherein the photogenerating layer contains a metal free phthalocyanine; an imaging member wherein the photogenerating layer contains an alkoxygallium phthalocyanine; a photoconductive imaging member with a blocking layer contained as a coating on a substrate, and an adhesive layer coated on the blocking layer; an imaging member further containing an adhesive layer and a hole blocking layer; a color method of imaging which comprises generating an electrostatic latent image on the imaging member, developing the latent image, transferring and fixing the developed electrostatic image to a suitable substrate; photoconductive imaging members comprised of a supporting substrate, a photogenerating layer, a hole transport layer and a top overcoating layer in contact with the hole transport layer or in embodiments in contact with the photogenerating layer, and in embodiments wherein a plurality of charge transport layers are selected, such as for example, from two to about ten and more specifically two, may be selected; and a photoconductive imaging member comprised of an optional supporting substrate, a photogenerating layer, and a first, second, and third charge transport layer.

In embodiments examples of C-ethers are as illustrated herein, and include, for example, ethers of the following formulas/structures

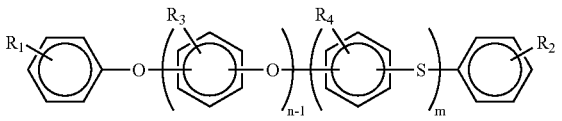

with n+m+1 benzene rings wherein n is a suitable number of, for example, from about 1 to about 9; m is a suitable number of, for example, from about 1 to about 9; n+m is from about 1 to about 10, or from about 3 to about 6, and linked by a combination of thioether and ether bonds; and wherein $R_1$, $R_2$, $R_3$ and $R_4$ may be the same or different and are, for example, H, halogen, an alkyl, aryl, alkoxy, cycloalkyl, substituted alkyl, substituted alkoxy, each with, for example, from about 1 to about 24 carbons, from about 6 to about 20 carbons, or from about 8 to about 18 carbons, aryl or substituted aryl with, for example, from about 6 to about 42 carbon atoms.

Specific examples of C-ethers include

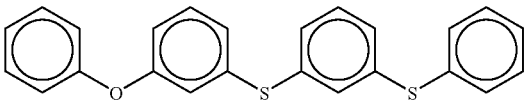

1-phenoxy-3-[[3-(phenylthio)phenyl]thio]benzene

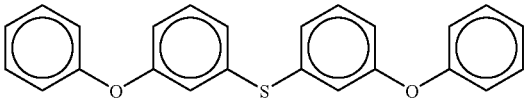

1,1-thiobis(3-phenoxybenzene)

1-phenoxy-3-[[3-(phenoxy)phenyl]thio]benzene, monoalkylated 1,1-thiobis(3-phenoxybenzene), monoalkylated 1-phenoxy-3-[[3-(phenylthio)phenyl]thio]benzene, monoalkylated 1-phenoxy-3-[[3-(phenoxy)phenyl]thio]benzene, dialkylated 1,1-thiobis(3-phenoxybenzene), dialkylated 1-phenoxy-3-[[3-(phenylthio)phenyl]thio]benzene, dialkylated 1-phenoxy-3-[[3-(phenoxy)phenyl]thio]benzene, trialkylated 1,1-thiobis(3-phenoxybenzene), trialkylated 1-phenoxy-3-[[3-(phenylthio)phenyl]thio]benzene, trialkylated 1-phenoxy-3-[[3-(phenoxy)phenyl]thio]benzene, and the like mixtures thereof. The weight percent of the C-ether in the charge transport layer or each layer is, for example, from about 0.1 to about 30, or from about 5 to about 20 weight percent.

In embodiments in place of the C-ethers there are selected polyphenyl ethers or a polyphenyl ether of the following formula/structure, such as those with n+1 benzene rings linked by ether bonds,

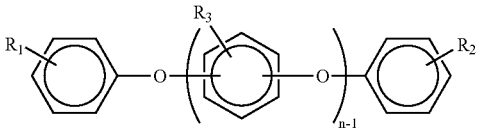

wherein n is a suitable number, such as for example, from about 1 to about 10, or from about 3 to about 6; and wherein each $R_1$, $R_2$, and $R_3$ may be the same or different, and are, for example, H, halide, an alkyl, aryl, alkoxy, substituted alkyl, substituted aryl, alkoxy with, for example, from about 1 to about 24 carbons, from about 6 to about 20 carbons, or from about 8 to about 18 carbons, and for aryl from 6 to about 42 carbon atoms. The R hydrocarbon groups may be bonded at any position of the aromatic ring.

Specific examples of polyphenyl ethers include m-diphenoxybenzene, bis(m-phenoxyphenyl)ether, m-phenoxyphenyl p-phenoxyphenyl ether, m-phenoxyphenyl o-phenoxyphenyl ether, bis(p-phenoxyphenyl)ether, p-phenoxyphenyl o-phenoxyphenyl ether, bis(o-phenoxyphenyl ether, bis(phenoxyphenyl)ether isomer mixture, m-phenoxyphenoxy m-biphenyl, m-bis(m-phenoxyphenoxy)benzene, 1-(m-phenoxyphenoxy)-3-(p-phenoxyphenoxy)benzene, p-bis(m-phenoxyphenoxy)benzene, 1-(m-phenoxyphenoxy)-4-(p-phenoxyphenoxy) benzene, m-bis(p-phenoxyphenoxy) benzene, p-bis(p-phenoxyphenoxy)benzene, o-bis(m-phenoxyphenoxy)benzene, m-bis(o-phenoxyphenoxy) benzene, p-bis(o-phenoxyphenoxy)benzene, o-bis(o-phenoxyphenoxy)benzene and bis(phenoxyphenoxy) benzene isomer mixture, and bis(phenoxyphenoxyphenyl) ether isomer mixture, and the like, and mixtures thereof. Commercial polyphenyl ethers that may be selected include SANTOVAC OS-124™ (polyphenyl ether), OS-105™ (alkylated diphenyl ether), and OS-138™ (polyphenyl ether), available from Santovac Fluids, LLC, St. Charles, Mo. The weight percent of the polyphenyl ether in the charge transport layer or layers is, for example, from about 0.1 to about 30, or from about 5 to about 20.

In place of the C-ethers and other ethers illustrated herein there can be selected polyphenyl thioethers of the following formula/structure, such as those with n+1 benzene rings linked by thioether bonds,

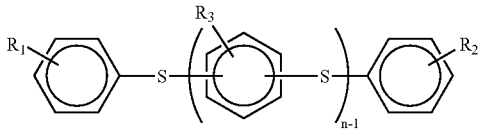

wherein n is a suitable number of, for example, from about 1 to about 10, or from about 3 to about 6; and wherein $R_1$, $R_2$, and $R_3$ may be the same or different and are, for example, H, halide or halogen, an alkyl, aryl, alkoxy, substituted alkyl, aryl, alkoxy with, for example, from about 1 to about 24 carbons, from about 6 to about 20 carbons, or from about 8 to about 18 carbons, and for aryl from about 6 to about 42 carbon atoms. The hydrocarbon R groups may be bonded at any position of the aromatic ring.

Specific examples of polyphenyl thioethers include diphenyl thioether, m-bis(phenylmercapto)benzene, o-bis(phenylmercapto)benzene, p-bis(phenylmercapto)benzene, bis (phenylmercapto)benzene isomer mixture, bis(m-phenylmercaptophenyl)su Ifide, bis(o-phenylmercaptophenyl)sulfide, bis(p-phenylmercaptophenyl)sulfide, m-phenylmercaptophenyl p-phenylmercaptophenyl sulfide, m-phenylmercaptophenyl o-phenylmercaptophenyl sulfide, p-phenylmercaptophenyl o-phenylmercaptophenyl sulfide, a bis(phenylmercaptophenyl)sulfide isomer mixture, m-bis(m-phenylmercapto phenylmercapto)benzene, 1-(m-phenylmercaptophenylmercapto)-3-(p-phenylmercaptophenylmercapto)benzene, p-bis (m-phenylmercaptophenylmercapto) benzene, 1-(m-phenylmercaptophenylmercapto)-4-(p-phenylmercapto phenylmercapto)benzene, m-bis(p-phenylmercaptophenylmercapto)benzene, p-bis(p-phenylmercaptophenylmercapto)benzene, o-bis(m-phenylmercapto phenylmercapto) benzene, m-bis(o-phenylmercaptophenylmercapto)benzene, p-bis(o-phenylmercaptophenylmercapto)benzene, o-bis(o-phenylmercapto phenylmercapto)benzene, a mixed bis(phenylmercaptophenylmercapto)benzene isomer mixture, and the like. Commercial polyphenyl thioethers that can be selected include SANTOVAC MCS-293™ (polyphenyl thioether), available from Santovac Fluids, LLC, St. Charles, Mo. The weight percent of the polyphenyl thioether in the charge transport layers or each layer is from about 0.1 to about 30 weight percent, or from about 5 to about 20 weight percent.

Examples of polyphenyl thioethers substituted with hydrocarbon groups, there can be selected mono-, di- or tri-alkylated polyphenyl thioethers obtained by bonding from about 1 to about 3 alkyl groups of from about 6 to about 20 carbon atoms, or from about 10 to about 17 carbon atoms. For example, there can be selected monoalkylated m-bis(phenylmercapto)benzene, dialkylated m-bis(phenylmercapto) benzene, trialkylated m-bis(phenylmercapto)benzene, as well as an alkylation product of bis(m-phenylmercaptophenyl)sulfide, m-bis(m-phenylmercaptophenylmercapto)benzene, and the like.

In further embodiments, there is disclosed herein the selection of thiophosphates, especially dialkyldithiophosphates like metal free or metal dialkyldithiophosphates, wherein metal includes, for example, zinc, molybdenum, lead, and antimony as additional components to be included in at least one of the charge transport layers, or optionally also or exclusively in the photogenerating layer, and wherein examples of the metal dialkyldithiophosphates are encompassed by or of the following formulas/structures

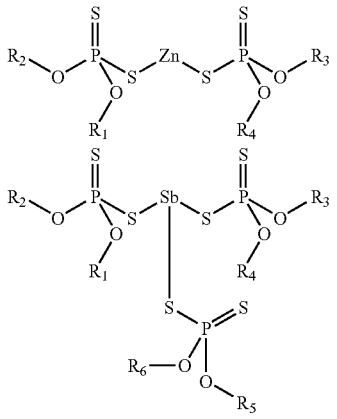

wherein $R_1$, $R_2$, $R_3$, $R_4$, $R_5$ and $R_6$ each independently represents a hydrogen atom; alkyl with, for example, from 1 to about 20 carbon atoms; cycloalkyl with, for example, from about 6 to about 26 carbon atoms; aryl, alkylaryl or arylalkyl groups with from about 6 to about 50 carbon atoms; a hydrocarbyl group containing, for example, from about 3 to about 20 carbon atoms, and containing an ester, ether, alcohol or carboxyl group; and an alkyl group which may be straight, chain or branched with, for example, from about 2 to about 18 carbon atoms, or from about 4 to about 8 carbon atoms. Examples of alkyl and alkoxy groups include ethyl, propyl, isopropyl, butyl, isobutyl, pentyl, hexyl ethylhexyl, and the like, and mixtures thereof; and the corresponding alkoxides.

Specific examples of metal dialkyldithiophosphates include molybdenum di(2-ethylhexyl)dithiophosphate, zinc diethyldithiophosphate, antimony diamyldithiophosphate, and the like. Commercial zinc dialkyldithiophosphates include ELCO 102™, 103™, 108™, 114™, JJ™, and 121™, available from Elco Corporation, Cleveland, Ohio. A number of the thiophosphates contain a certain amount of petroleum distillates, mineral oils such as ValPar500™, available from Valero Energy Corporation, San Antonio, Tex. Commercial molybdenum dialkyldithiophosphates include MOLYVAN L™ (molybdenum di(2-ethylhexyl)phosphorodithioate), available from R.T. Vanderbilt Company, Inc., Norwalk, Conn. Commercial antimony dialkyldithiophosphates include VANLUBE 622™ and 648™ (antimony dialkylphosphorodithioate), available from R.T. Vanderbilt Company, Inc., Norwalk, Conn.

Various effective amounts of the thiophosphates, which in embodiments function primarily as permitting excellent photoconductor electricals, although in theory there could be interactions between the thiophosphates and other components, such as the ethers, can be added to each charge transport layer and/or to the photogenerating layer components, such as from about 0.01 to about 30 weight percent, from about 0.1 to about 10 weight percent, or from about 0.5 to about 5 weight percent in the charge transport layer or layers; and from about 0.1 to about 40 weight percent, from about 1 to about 20 weight percent, or from about 5 to about 15 weight percent in the photogenerating layer.

Examples of components or materials optionally incorporated into the charge transport layers or at least one charge transport layer to, for example, enable improved lateral charge migration (LCM) resistance include hindered phenolic antioxidants, such as tetrakis methylene(3,5-di-tert-butyl-4-hydroxy hydrocinnamate) methane (IRGANOX 1010™, available from Ciba Specialty Chemical), butylated hydroxytoluene (BHT), and other hindered phenolic antioxidants including SUMILIZER BHT-R™, MDP-S™, BBM-S™, WX-R™, NW™, BP-76™, BP-101™, GA-80™, GM™ and GS™ (available from Sumitomo Chemical Co., Ltd.), IRGANOX 1035™, 1076™, 1098™, 1135™, 1141 ™, 1222™, 1330™, 1425WL™, 1520L™, 245™, 259™, 3114™, 3790™, 5057™ and 565™ (available from Ciba Specialties Chemicals), and ADEKA STAB AO-20™, AO-30™, AO-40™, AO-50™, AO-60™, AO-70™, AO-80™ and AO-330™ (available from Asahi Denka Co., Ltd.); hindered amine antioxidants such as SANOL LS-2626™, LS-765™, LS-770™ and LS-744™ (available from SNKYO CO., Ltd.), TINUVIN 144™ and 622LD™ (available from Ciba Specialties Chemicals), MARK LA57™, LA67™, LA62™, LA68™ and LA63™ (available from Asahi Denka Co., Ltd.), and SUMILIZER TPS™ (available from Sumitomo Chemical Co., Ltd.); thioether antioxidants such as SUMILIZER TP-D™ (available from Sumitomo Chemical Co., Ltd); phosphite antioxidants such as MARK 2112™, PEP-8™, PEP-24G™, PEP-36™, 329K™ and HP-10™ (available from Asahi Denka Co., Ltd.); other molecules such as bis(4-diethylamino-2-methylphenyl)phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layers is from about 0 to about 20, from about 1 to about 10, or from about 3 to about 8 weight percent.

Primarily for purposes of brevity, the examples of each of the substituents and each of the components/compounds/molecules, polymers, (components) for each of the layers, specifically disclosed herein are not intended to be exhaustive. Thus, a number of components, polymers, formulas, structures, and R group or substituent examples and carbon chain lengths not specifically disclosed or claimed are intended to be encompassed by the present disclosure and claims. For example, these substituents include suitable known groups, such as aliphatic and aromatic hydrocarbons with various carbon chain lengths, and which hydrocarbons can be substituted with a number of suitable known groups and mixtures thereof. Also, the carbon chain lengths are intended to include all numbers between those disclosed or claimed or envisioned, thus from 1 to about 20 carbon atoms, and from 6 to about 42 carbon atoms includes 1, 2, 3, 4, 5, 6, 7, 8, 9, 10, 11, 12, 13, 14, 15 up to 42 or more. Similarly, the thickness of each of the layers, the examples of components in each of the layers, the amount ranges of each of the components disclosed and claimed is not exhaustive, and it is intended that the present disclosure and claims encompass other suitable parameters not disclosed or that may be envisioned.

The following Examples are being submitted to illustrate embodiments of the present disclosure. These Examples are intended to be illustrative only, and are not intended to limit the scope of the present disclosure. Also, parts and percentages are by weight unless otherwise indicated. Comparative Examples and data are also provided.

COMPARATIVE EXAMPLE 1

An imaging member was prepared by providing a 0.02 micrometer thick titanium layer coated (the coater device) on a biaxially oriented polyethylene naphthalate substrate (KALEDEX™ 2000) having a thickness of 3.5 mils, and applying thereon, with a gravure applicator, a solution containing 50 grams of 3-amino-propyltriethoxysilane, 41.2 grams of water, 15 grams of acetic acid, 684.8 grams of denatured alcohol, and 200 grams of heptane. This layer was then dried for about 5 minutes at 135° C. in the forced air dryer of the coater. The resulting blocking layer had a dry thickness of 500 Angstroms. An adhesive layer was then prepared by applying a wet coating over the blocking layer, using a gravure applicator, and which adhesive contains 0.2 percent by weight based on the total weight of the solution of copolyester adhesive (ARDEL D100™ available from Toyota Hsutsu Inc.) in a 60:30:10 volume ratio mixture of tetrahydrofuran/monochlorobenzene/methylene chloride. The adhesive layer was then dried for about 5 minutes at 135° C. in the forced air dryer of the coater. The resulting adhesive layer had a dry thickness of 200 Angstroms.

A photogenerating layer dispersion was prepared by introducing 0.45 grams of the known polycarbonate LUPILON 200™ (PCZ-200) or POLYCARBONATE Z™, weight average molecular weight of 20,000, available from Mitsubishi Gas Chemical Corporation, and 50 milliliters of tetrahydrofuran into a 4 ounce glass bottle. To this solution were added 2.4 grams of hydroxygallium phthalocyanine (Type V) and 300 grams of ⅛-inch (3.2 millimeters) diameter stainless steel shot. This mixture was then placed on a ball mill for 8 hours. Subsequently, 2.25 grams of PCZ-200 were dissolved in 46.1 grams of tetrahydrofuran, and added to the hydroxygallium phthalocyanine dispersion. This slurry was then placed on a shaker for 10 minutes. The resulting dispersion was, thereafter, applied to the above adhesive interface with a Bird applicator to form a photogenerating layer having a wet thickness of 0.25 mil. A strip about 10 millimeters wide along one edge of the substrate web bearing the blocking layer and the adhesive layer was deliberately left uncoated by any of the photogenerating layer material to facilitate adequate electrical contact by the ground strip layer that was applied later. The charge generation layer was dried at 135° C. for 5 minutes in a forced air oven to form a dry photogenerating layer having a thickness of 0.4 micrometer.

The resulting imaging member web was then overcoated with a two-layer charge transport layer. Specifically, the photogenerating layer was overcoated with a charge transport layer (the bottom layer) in contact with the photogenerating layer. The bottom layer of the charge transport layer was prepared by introducing into an amber glass bottle in a weight ratio of 1:1 N,N'-diphenyl-N,N'-bis(3-methylphenyl)-1,1'-biphenyl-4,4'-diamine, and MAKROLON 5705®, a known polycarbonate resin having a molecular weight average of from about 50,000 to 100,000, commercially available from Farbenfabriken Bayer A.G. The resulting mixture was then dissolved in methylene chloride to form a solution containing 15 percent by weight solids. This solution was applied on the photogenerating layer to form the bottom layer coating that upon drying (120° C. for 1 minute) had a thickness of 14.5 microns. During this coating process, the humidity was equal to or less than 15 percent.

The bottom layer of the charge transport layer was then overcoated with a top layer. The charge transport layer solution of the top layer was prepared as described above for the bottom layer. This solution was applied on the bottom layer of the charge transport layer to form a coating that upon drying (120° C. for 1 minute) had a thickness of 14.5 microns. During this coating process the humidity was equal to or less than 15 percent.

EXAMPLE I

An imaging member was prepared by repeating the process of Comparative Example 1 except that to the photogenerating layer dispersion of Comparative Example 1 were added 0.24 grams of zinc dialkyldithiophosphate (ZDDP ELCO-103™, wherein alkyl is a mixture of primary and secondary propyl, butyl and pentyl), commercially available from Elco Corporation.

EXAMPLE II

An imaging member was prepared by repeating the process of Comparative Example 1 except that to the photogenerating layer dispersion of Comparative Example 1 were added 0.24 grams of zinc dialkyldithiophosphate (ZDDP ELCO-102™, wherein alkyl is a mixture of primary butyl and octyl), commercially available from Elco Corporation.

EXAMPLE III

An imaging member was prepared by repeating the process of Comparative Example 1 except that to the photogenerating layer dispersion of Comparative Example 1 were added 0.72 grams of the above zinc dialkyldithiophosphate (ZDDP ELCO-103™), commercially available from Elco Corporation.

EXAMPLE IV

An imaging member was prepared by repeating the process of Comparative Example 1 except that (1) the top layer of the charge transport layer was prepared by introducing into an amber glass bottle in a weight ratio of 1:1:0.1 N,N'-diphenyl-N,N'-bis(3-methylphenyl)-1,1'-biphenyl-4,4'-diamine, MAKROLON 5705®, a polycarbonate resin having a molecular weight (weight average molecular weight) of from about 50,000 to about 100,000, commercially available from Farbenfabriken Bayer A.G, and IRGANOX 1010™, tetrakis methylene(3,5-di-tert-butyl-4-hydroxy hydrocinnamate), commercially available from Ciba Specialty Chemical. The resulting mixture was dissolved in methylene chloride to form a solution containing 15 percent by weight solids. (2) Further, to the photogenerating layer dispersion of Comparative Example 1 are added 0.24 grams of zinc dialkyldithiophosphate (ZDDP ELCO-103™), commercially available from Elco Corporation.

EXAMPLE V

An imaging member was prepared by repeating the process of Comparative Example 1 except that (1) the top layer of the charge transport layer was prepared by introducing into an amber glass bottle in a weight ratio of 1:1:0.1 N,N'-diphenyl-N,N'-bis(3-methylphenyl)-1,1'-biphenyl-4,4'-diamine, MAKROLON 5705®, a polycarbonate resin having a molecular weight of from about 50,000 to about 100,000, commercially available from Farbenfabriken Bayer A.G, and IRGANOX 1010™ commercially available from Ciba Specialty Chemical. The resulting mixture was dissolved in methylene chloride to form a solution containing 15 percent by weight solids. (2) Further, to the photogenerating layer dispersion of Comparative Example 1 was added 0.72 grams of zinc dialkyldithiophosphate (ZDDP ELCO-103™), commercially available from Elco Corporation.

Electrical Property Testing:

The above prepared six photoreceptor devices were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic (PIDC) curves from which the photosensitivity and surface potentials at various exposure intensities were measured. Additional electrical characteristics were obtained by a series of charge-erase cycles with incrementing surface potential to generate several voltage versus charge density curves. The scanner is equipped with a scorotron set to a constant voltage charging at various surface potentials. The devices were tested at surface potentials of 500 with the exposure light intensity incrementally increased by means of regulating a series of neutral density filters; the exposure light source is a 780 nanometer light emitting diode. A xerographic simulation was completed in an environmentally controlled light tight chamber at ambient conditions (40 percent relative humidity and 22° C.). The devices were also cycled for 10,000 cycles electrically with charge-discharge-erase. Twelve photoinduced discharge characteristic (PIDC) curves were generated, one for each of the above prepared photoconductors at both cycle=0 and cycle=10,000. The results are summarized in the table that follows.

| | V (3.5 ergs/cm$^2$ (V) | |
|---|---|---|
| | Cycle = 0 | Cycle = 10,000 |
| Comparative Example 1 | 59 | 121 |
| Example I | 38 | 46 |
| Example II | 35 | 45 |
| Example III | 34 | 27 |
| Example IV | 54 | 54 |
| Example V | 37 | 33 |

In embodiments there is disclosed a number of improved characteristics for the photoconductive members as determined by the generation of known PIDC curves, such as minimization or prevention of $V_r$ cycle up by the physical doping of the thiophosphate like the above dialkyldithiophosphate in the photogenerating layer. More specifically, in the above Table, V (3.5 ergs/cm$^2$) represents surface potential of the device when exposure is 3.5 ergs/cm$^2$, and is used to characterize the PIDC. Incorporation of the thiophosphate into the photogenerating layer reduces V (3.5 ergs/cm$^2$), and prevents cycle up with extended cycling.

Also, in embodiments, incorporation of the thiophosphate into the photogenerating layer can result in a photoconductor with improved, that is reduced, ghosting as compared to the comparative Example 1 member.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. An imaging member comprising an optional supporting substrate, a photogenerating layer, and at least one charge transport layer, and wherein said photogenerating layer contains at least one thiophosphate, and wherein said thiophosphate is at least one of a dialkyldithiophosphate as represented by the formulas

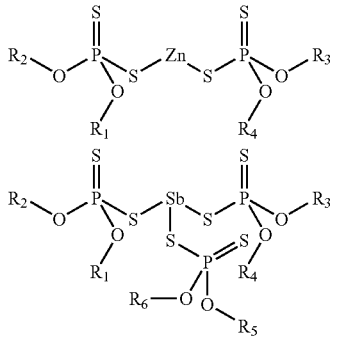

wherein $R_1$, $R_2$, $R_3$, $R_4$, $R_5$ and $R_6$ each independently represents a hydrogen atom, alkyl, cycloalkyl, aryl, alkylaryl or arylalkyl, and at least one of $R_1$, $R_2$, $R_3$ or $R_4$ is not hydrogen; and wherein said charge transport layer is free of said thiophosphate; and wherein said at least one charge transport layer contains an antioxidant.

2. An imaging member in accordance with claim 1 wherein said photogenerating layer is comprised of at least one photogenerating pigment and said thiophosphate.

3. An imaging member in accordance with claim 1 wherein said photogenerating layer is comprised of a photogenerating component, a polymer binder, and said at least one thiophosphate.

4. An imaging member in accordance with claim 1 wherein said at least one thiophosphate is one.

5. An imaging member in accordance with claim 1 wherein said charge transport layer is comprised of aryl amine molecules or optionally mixtures thereof, and which aryl amines are of the formula wherein X is selected from the group consisting of alkyl, alkoxy, aryl and halogen

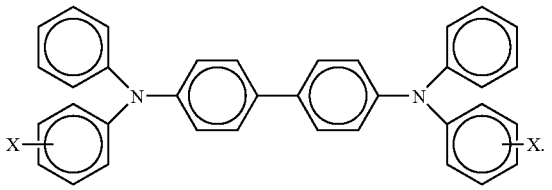

6. An imaging member in accordance with claim 5 wherein said alkoxy and alkyl contain from about 1 to about 10 carbon atoms.

7. An imaging member in accordance with claim 5 wherein said aryl amine is N,N'-diphenyl-N,N-bis(3-methylphenyl)-1,1'-biphenyl-4,4'-diamine.

8. An imaging member in accordance with claim 1 wherein said charge transport layer is comprised of aryl amine molecules, and which aryl amines are of the formula wherein each X and Y is independently selected from the group consisting of alkyl, alkoxy, aryl and halogen

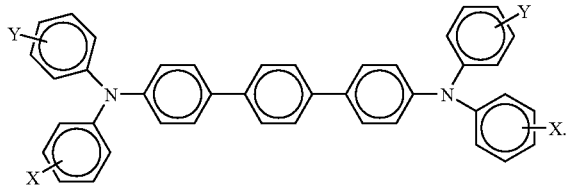

9. An imaging member in accordance with claim 8 wherein each alkoxy and alkyl contains from about 1 to about 10 carbon atoms; aryl contains from 6 to about 36 carbon atoms; and halogen is chloride, bromide, fluoride, or iodide.

10. An imaging member in accordance with claim 8 wherein said aryl amine is selected from the group consisting of N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-(N,N'-bis-(4-isopropylphenyl)-[p-terphenyl]-4,4"-diamine, N,N'-bis(4-butylphenyl)-N,N'-bis-(2-ethyl-6-methylphenyl)-[p-terphe-nyl]-4,4"-diamine, N,N'-bis(4-butylphenyl)-N,N'-bis-2,5-dimethylphenyl)-[p-terphenyl]-4,4"-diamine, and N,N'-diphenyl-N,N'-bis(3-chlorophenyl)-[p-terphenyl]-4,4"-diamine, and optionally mixtures thereof.

11. An imaging member in accordance with claim 1 wherein said at least one charge transport layer is from 1 to about 7 layers, and said at least one thiophosphate is from 1 to about 3.

12. An imaging member in accordance with claim 1 wherein said at least one charge transport layer is from 1 to about 3 layers.

13. An imaging member in accordance with claim 1 wherein said at least one charge transport layer is comprised of a top charge transport layer and a bottom charge transport layer, and wherein said bottom layer is situated between said photogenerating layer and said top layer.

14. An imaging member in accordance with claim 13 wherein said top layer is comprised of at least one charge transport component and at least one polymer binder, and said bottom layer is comprised of at least one charge transport component and at least one resin binder.

15. An imaging member in accordance with claim 1 wherein said thiophosphate is a zinc dialkyldithiophosphate.

16. An imaging member in accordance with claim 1 wherein said photogenerating layer is coated from a photogenerating dispersion prepared by adding said thiophosphate into the dispersion of a photogenerating component, and a polymeric resin, or by ball milling said thiophosphate, a photogenerating component and a polymeric resin.

17. An imaging member in accordance with claim 1 wherein said photogenerating layer is comprised of at least one of a metal phthalocyanine, metal free phthalocyanine, titanyl phthalocyanine, a halogallium phthalocyanine, a perylene, or mixtures thereof.

18. An imaging member in accordance with claim 17 wherein said photogenerating layer is comprised of a chlorogallium phthalocyanine pigment or a hydroxygallium phthalocyanine.

19. An imaging member in accordance with claim 1 wherein $R_1$, $R_2$, $R_3$, $R_4$, $R_5$ and $R_6$ each independently represents alkyl containing from 1 to about 20 carbon atoms; cycloalkyl containing from 6 to about 26 carbon atoms; aryl, alkaryl or arylalkyl each containing from about 6 to about 50 carbon atoms; or optionally a hydrocarbyl group.

20. An imaging member in accordance with claim 1 wherein said thiophosphate is a zinc dialkyldithiophosphate, and wherein said alkyl is a straight chain or branched alkyl with from about 2 to about 18 carbon atoms.

21. An imaging member in accordance with claim 1 wherein said thiophosphate is present in an amount of from about 0.1 to about 40 weight percent.

22. An imaging member in accordance with claim 1 wherein said thiophosphate is present in an amount of from about 0.5 to about 15, or from about 1 to about 10 weight percent.

23. An imaging member in accordance with claim 1 wherein at least one photogenerating layer is one, and wherein at least one thiophosphate is from 1 to about 3.

24. A process for the preparation of a flexible photoconductive member consisting essentially of provided said photoconductive member that includes in sequence a substrate, a photogenerating layer, and at least one charge transport layer by adding to said photogenerating layer at least one dialkyldithiophosphate of the formulas

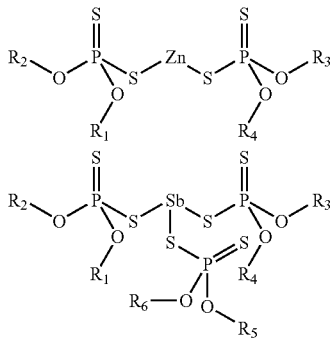

wherein $R_1$, $R_2$, $R_3$, $R_4$, $R_5$ and $R_6$ each independently represents a hydrogen atom, alkyl, cycloalkyl, aryl, alkylaryl or arylalkyl, and at least one of $R_1$, $R_2$, $R_3$ or $R_4$ is not hydrogen; wherein said photoconductor when incorporated into a xerographic printing system permits the minimization of Vr cycle up; and wherein said at least one charge transport layer contains an antioxidant.

25. A member in accordance with claim 24 where at least one is one for said photogenerating layer, at least one is two for said charge transport layer, and at least one is one for said thiophosphate.

26. An imaging member in accordance with claim 1 further including a hole blocking layer, and an adhesive layer.

27. An imaging member in accordance with claim 1 wherein said thiophosphate is present in said at least one charge transport layer.

28. A photoconductor comprising a substrate, a photogenerating layer, and a plurality of charge transport layers comprised of at least one charge transport component, and wherein said photogenerating layer is comprised of a photogenerating pigment or pigments, and at least one dialkyldithiophosphate of the formulas

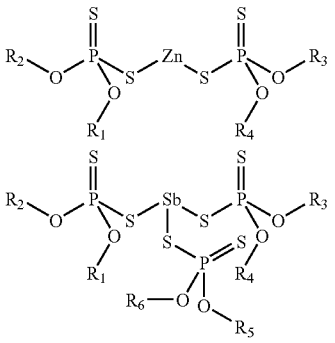

wherein $R_1$, $R_2$, $R_3$, $R_4$, $R_5$ and $R_6$ each independently represents a hydrogen atom or a suitable hydrocarbon, and at least one of $R_1$, $R_2$, $R_3$ or $R_4$ is not hydrogen; and wherein said photogenerating layer and at least one charge transport layer include a resin binder; wherein said at least one charge transport layer is from 2 to about 7, said photogenerating layer is situated between said substrate and said at least one charge transport layer; and wherein at least one charge transport layer contains an antioxidant.

* * * * *